US005114200A

United States Patent [19]

Visnyouszky et al.

[11] Patent Number: 5,114,200

[45] Date of Patent: May 19, 1992

[54] GRAVITY OPERATED AUTOMATIC HOOK

[75] Inventors: Louis Visnyouszky, Twinsburg; Adam G. Bay, Chesterland, both of Ohio

[73] Assignee: Gould Inc., Eastlake, Ohio

[21] Appl. No.: 605,783

[22] Filed: Oct. 30, 1990

[51] Int. Cl.[5] ..... B66C 1/34

[52] U.S. Cl. ..... 294/81.56; 294/82.33

[58] Field of Search ..... 294/67.3, 67.31, 68.26, 294/68.27, 68.3, 81.5, 81.56, 82.19, 82.2, 82.24–82.27, 82.31–82.34; 242/58.6, 79, 85, 129; 414/911

[56] References Cited

U.S. PATENT DOCUMENTS

| | | | |
|---|---|---|---|
| 90,738 | 6/1869 | Foster, Jr. . | |
| 1,166,382 | 12/1915 | Morse . | |
| 1,202,239 | 10/1916 | Stuebner | 294/68.27 |
| 1,900,227 | 3/1933 | Craig | 294/82.33 X |
| 2,085,012 | 6/1937 | Dixon | 294/82.31 |
| 2,677,575 | 5/1954 | Phillips | 294/82.33 X |
| 2,737,303 | 3/1956 | Held et al. . | |
| 3,167,345 | 1/1965 | Dukes | 294/82.31 |
| 3,630,562 | 12/1971 | Metz | 294/82.33 |
| 3,926,467 | 12/1975 | Crissy et al. . | |
| 4,609,219 | 9/1986 | Go | 294/82.24 |
| 4,744,720 | 5/1988 | Kremar | 414/748 |
| 4,778,122 | 10/1988 | Snygg | 242/58.6 |

FOREIGN PATENT DOCUMENTS

| | | | |
|---|---|---|---|
| 2584154 | 1/1987 | France | 294/82.33 |
| 703477 | 12/1974 | U.S.S.R. | 294/68.27 |
| 1493582 | 7/1989 | U.S.S.R. | 294/81.56 |

*Primary Examiner*—Johnny D. Cherry

*Attorney, Agent, or Firm*—D. Peter Hochberg; Mark Kusner; Louis J. Weisz

[57] ABSTRACT

An arresting device for gripping a cylindrical portion of an object having a hook member and a latch member which are operable to interact with each other to grip the object and hold it in a predetermined position. The device is operable to automatically release the object when such object is resupported.

5 Claims, 7 Drawing Sheets

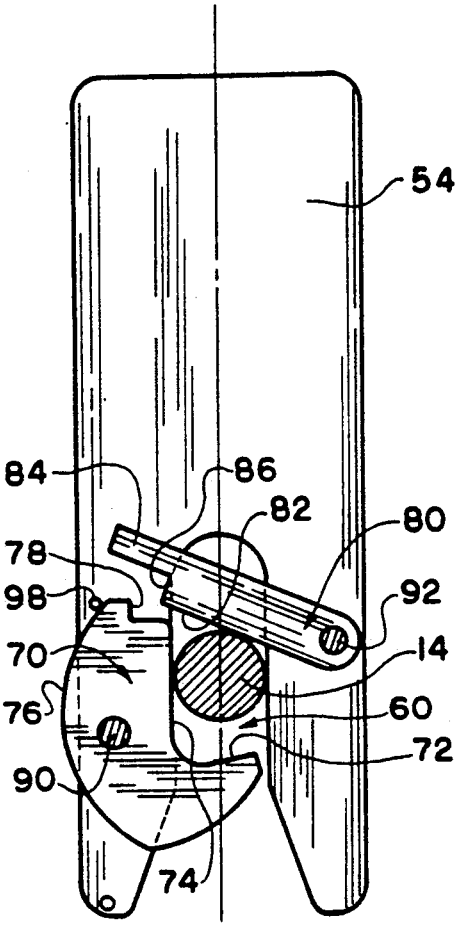
FIG. 7B
FIG. 7C
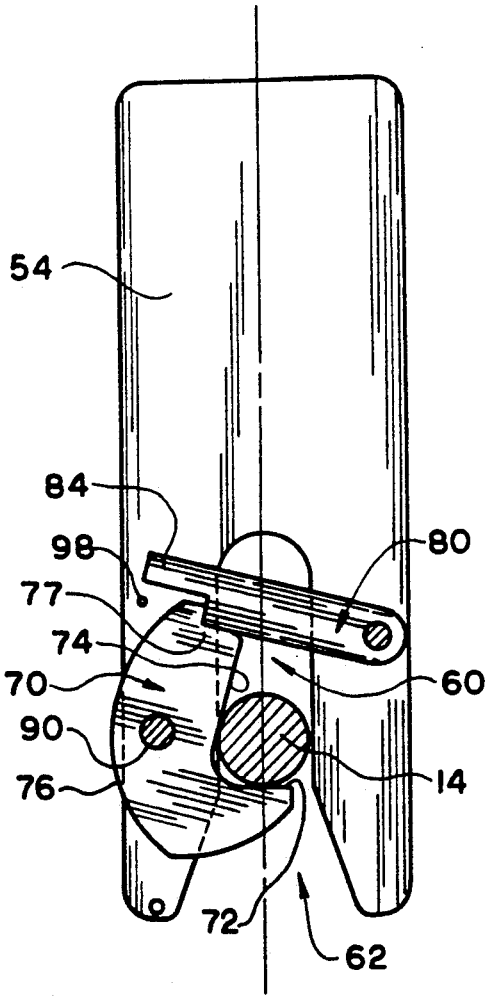

FIG. 7D
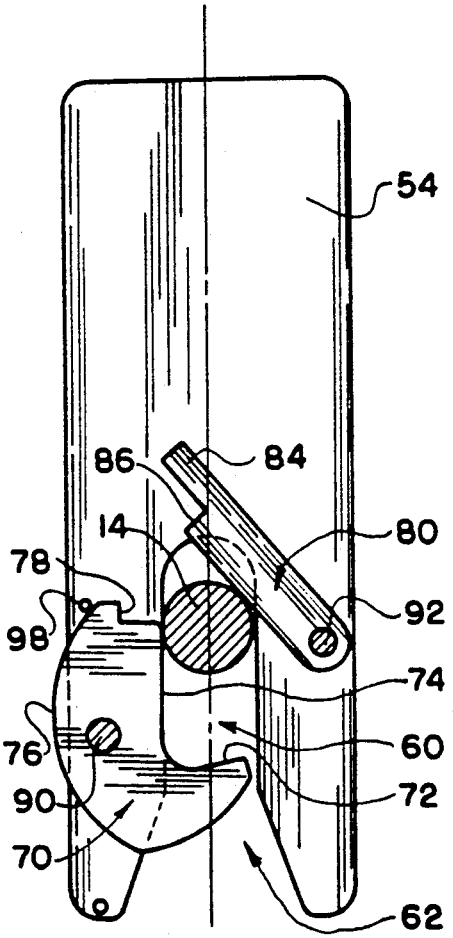
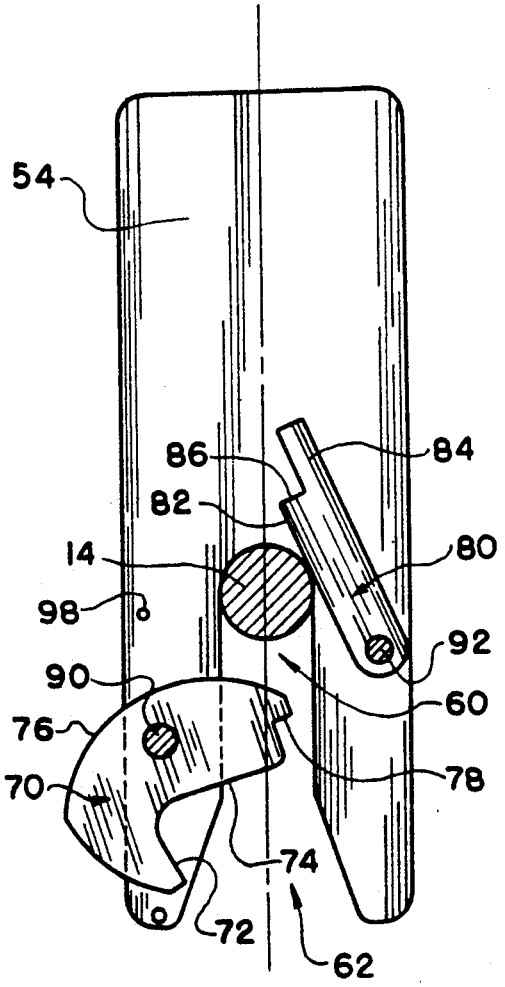
FIG. 7E

GRAVITY OPERATED AUTOMATIC HOOK

FIELD OF THE INVENTION

The present invention relates generally to arresting devices for seizing objects and, more particularly, to an improved suspension arrestor adapted for use in transferring generally elongated objects having cylindrical ends. The present invention is particularly application for transferring rolls of sheet material wound onto spools and will be described with particular reference thereto, although it would be appreciated that the present invention finds advantageous application in handling other objects having cylindrical or near cylindrical ends.

BACKGROUND OF THE INVENTION

In the production of copper foil, a continuous sheet of foil is formed by an electrodeposition process. The continuous foil produced is typically wound into a roll on an elongated spindle having distal ends which extend beyond the roll for handling purposes. It is not unusual for such rolls to be seven (7) feet or more in length and several feet in diameter. In this respect, large rolls of foil are much like rolls of paper produced in a paper mill. As will be appreciated, a roll of copper foil of such dimensions is nearly equal in weight to a solid piece of copper of similar size. Due to its weight, such a roll is typically moved by a crane system using some form of hook arrangement to grasp the exposed distal ends of the spindle. Such hook arrangements generally require some manual involvement to either secure the hook to the spindle ends, or to remove the hook therefrom once the roll has been moved. Complicated remotely controlled systems utilizing mechanical or electrical actuating elements are also known for accomplishing essentially the same purpose.

The present invention overcomes the foregoing problems and provides an arresting device which will automatically secure itself to a cylindrical portion of a workpiece to permit movement of such workpiece and which will automatically release itself from the workpiece when the workpiece is resupported, the lifting device being operable without human intervention and without mechanical or electrical actuating devices.

SUMMARY OF THE INVENTION

In accordance with the present invention, there is provided an arresting device for gripping a generally cylindrical shaft. The arresting device includes plate means having an elongated slot extending therein, the slot being dimensioned to have a width slightly greater than the diameter of the shaft to be gripped and being operable to receive the shaft therein, when the shaft is generally perpendicular to the plate means. Hook means having a first cam surface, a support surface and a latch abutting surface is pivotally mounted to the plate means to one side of the slot, the cam surface being in a predetermined position relative to the support surface. The hook means is movable between a first position wherein the first cam surface generally traverses the slot and a second position wherein the support surface generally traverses the slot. Latch means having a cam surface and a hook abutting surface is pivotally mounted to the plate means. The latch means is biased toward the hook means wherein the latch cam surface intersects the slot and the latch abutting surface on the hook means abuts the hook abutting surface on the latch means to hold the hook means in the second position and to confine the shaft within the slot.

It is an object of the present invention to provide a lifting device for moving generally elongated objects having generally cylindrical end portions.

It is another object of the present invention to provide a device as described above which will automatically grasp and support a load, and will automatically release the load when the load is resupported.

Another object of the present invention is to provide a device as described above which is operable without electrical or mechanical actuating devices.

A still further object of the present invention is to provide a lifting device as described above for moving a large roll of sheet material which is wound onto a shaft or spindle.

A still further object of the present invention is to provide a device as described above which is simple to manufacture and operate and which is dependable and safe.

These and other objects and advantages will become apparent from the following description of preferred embodiment taken together with the accompanying drawings.

A BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIGS. 7A–7F are schematic views illustrating the general operation of the lifting device shown in FIG. 1.

DETAILED DESCRIPTION OF PREFERRED EMBODIMENT

Figure 1:
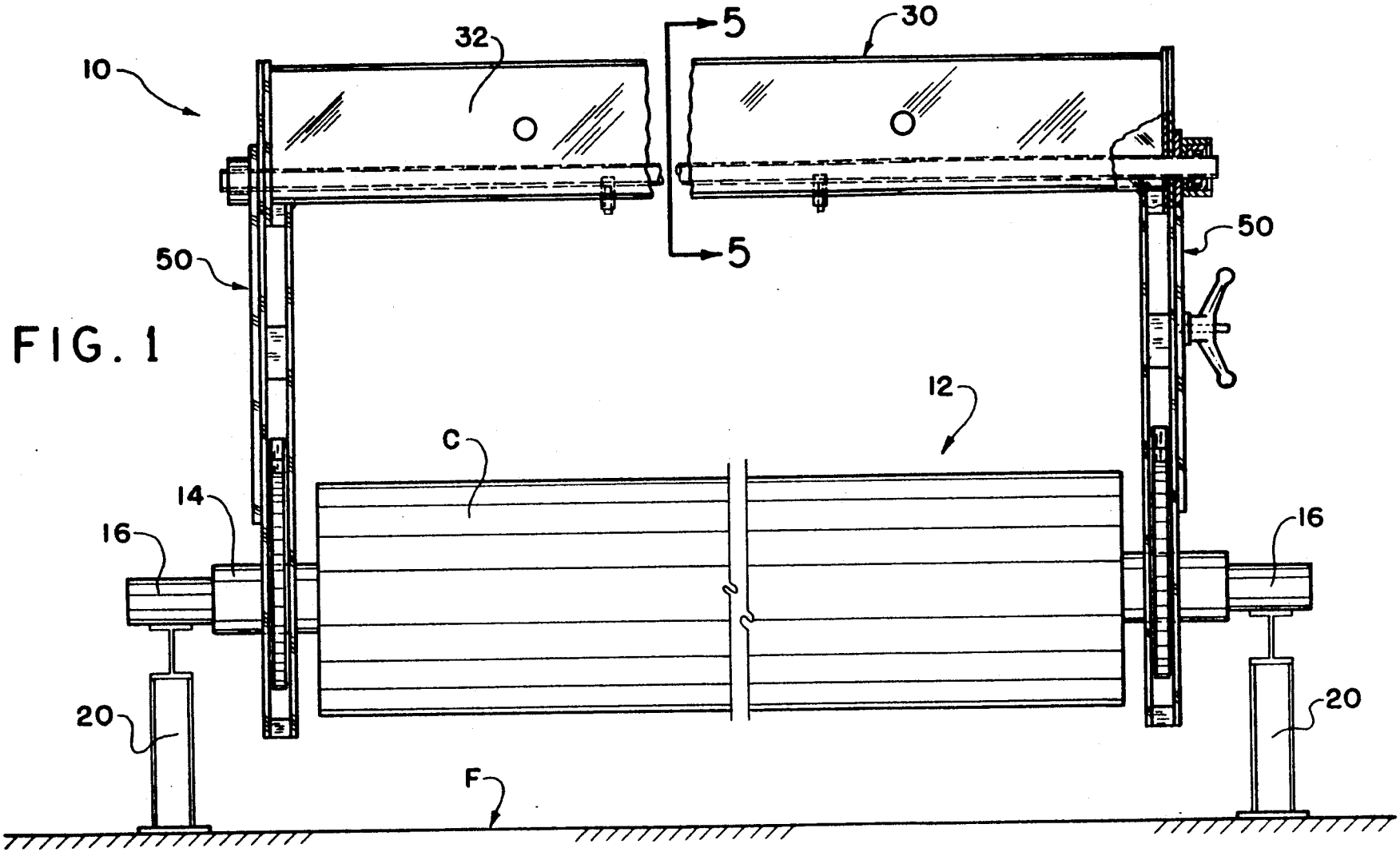
FIG. 1 is a partially-sectioned, front elevational view of a lifting device illustrating a preferred embodiment of the present invention.

Referring now to the drawings wherein the showings are for the purpose of illustrating a preferred embodiment of the invention only and not for the purpose of limiting same, FIG. 1 shows a lifting device 10 according to the present invention. The present invention will be hereinafter described with applications to moving rolls of sheet material wound onto a shaft or the like. It will be appreciated, however, that the present invention has broader use and may find advantageous application in moving other types of loads or workpieces having cylindrical portions at the ends thereof.

In the embodiment shown, lifting device 10 is adapted for moving a roll 12 of sheet material, specifically copper foil, designated C in the drawings. The copper foil is wound onto a shaft 14, the distal ends of which extend beyond the ends of the copper foil roll. The extreme ends of shaft 14 include a reduced portion 16.

To ensure that the sheet material itself does not rest on the ground or floor, designated F in the drawings, support stands 20 are provided to elevate shaft 14 and roll 12, as shown in FIG. 1. Support stands 20, in and of themselves, form no part of the present invention and are shown merely to illustrate the typical position and spacing of roll 12 relative to the floor surface. In this respect, a predetermined distance between shaft 14 and the floor surface is required for the operation of the present invention, as will be described and understood in greater detail below.

Figure 4:
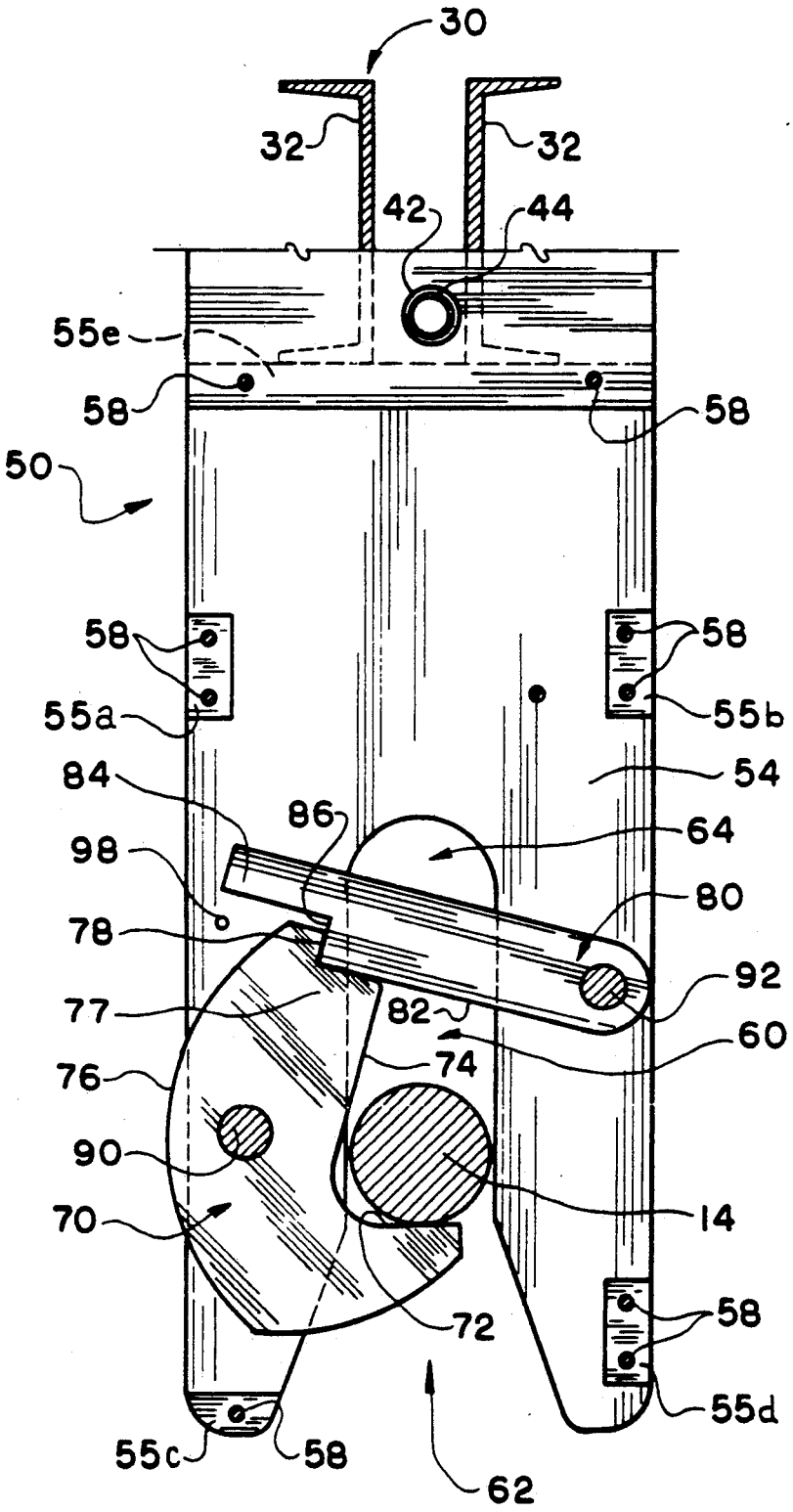
FIG. 4 is a sectional view taken along lines 4—4 of FIG. 3.
Figure 5:
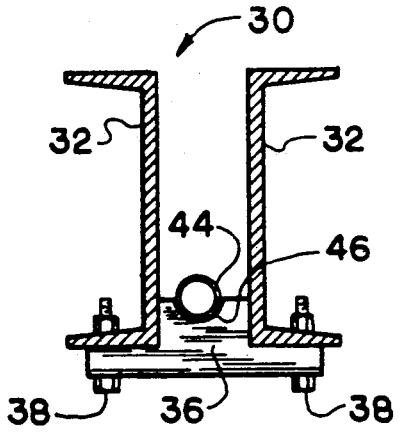
FIG. 5 is a sectional view taken along lines 5—5 of FIG. 1.

Broadly stated, lifting device 10 is generally comprised of a beam 30 having arresting arms 50 at the ends therof. In the embodiment shown, beam 30 is generally comprised of two (2) side-by-side, spaced-apart channels 32 as is best seen in FIG. 4 and FIG. 5. End plates 34 are secured to the ends of channels 32 to form composite beam 30. Reinforcing blocks 36, best seen in FIG. 5, are fastened to the lower flanges of channels 32 by conventionally-known fasteners 38 to provide additional rigidity to beam 30. Each end plate 34 includes an aperture 42 (best seen in FIG. 4) formed therethrough, which aperture 42 is dimensioned to receive an elongated cylindrical pipe 44, which extends along the length of beam 30 between channels 32. According to the present invention, the upper surfaces of reinforcing blocks 36 are preferably formed to have a cylindrical recess 46 dimensioned to correspond to the diameter of pipe 44 and to provide a support surface therefor. As best illustrated in FIG. 4, pipe 44 is not symmetrically disposed between channels 32, but rather is positioned closer to one of the channels.

Figure 2:
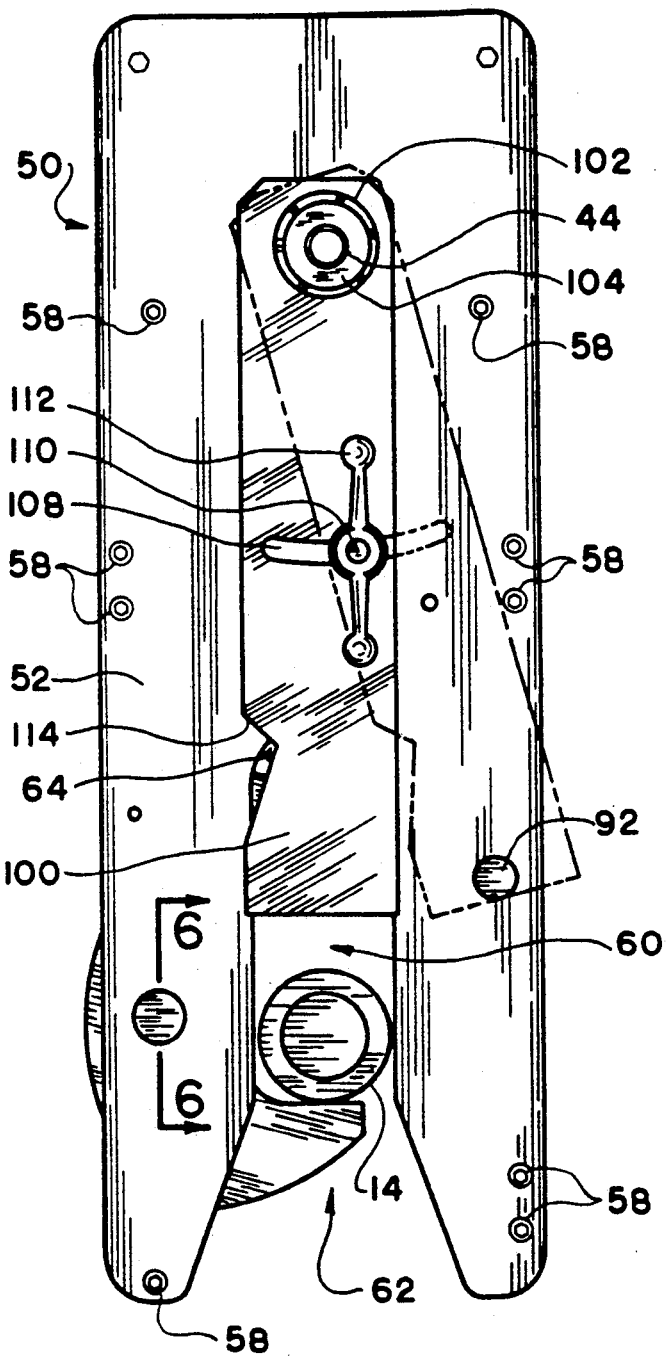
FIG. 2 is an enlarged end view of the lifting device shown in FIG. 1 showing an arresting arm.
Figure 3:
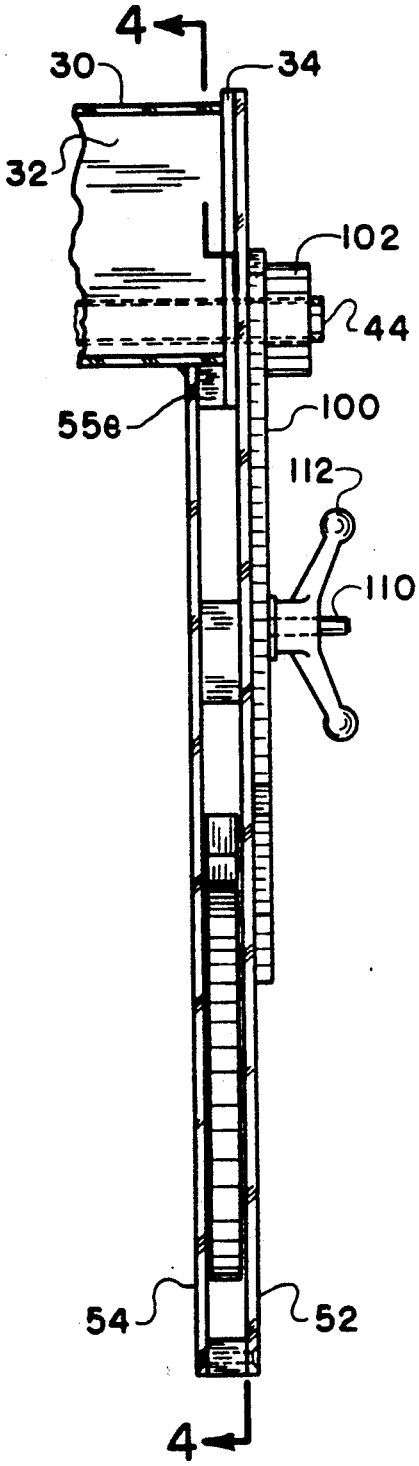
FIG. 3 is an enlarged elevational view of the right-hand portion of the lifting device shown in FIG. 1.

Arresting arms 50 are generally comprises of two (2), spaced-apart, side-by-side plates 52, 54. Spacer blocks 55*a*, 55*b*, 55*c*, 55*d*, and a spacer bar 55*e* are disposed between plates 52, 54, as best shown in FIGS. 3 and 4. Conventionally-known fasteners 58 extend through plate 52 spacer blocks, 55*a*, 55*b*, 55*c*, 55*d*, and spacer bar 55*e* and secure plates 52, 54 to each other. Plates 52, 54 are generally perpendicular to beam 30 and secured thereto. In this respect, the upper end of plate 54 is secured to the bottom of beam 30, as shown in FIG. 3. Plates 52 is dimensioned to overlap end plate 34. Spacer bar 55*e* is disposed against the bottom of beam 30 between end plate 34 and plate 54. Fasteners 58 extend through plates 52, 34 into bar 55*e* and plate 54 to secure the respective components together. Plates 52, 54 each include an elongated slot 60 formed therein as seen in FIG. 2 and FIG. 4. Slot 60 includes a flared open end 62 and a closed end 64. Slot 60 is dimensioned to have a width slightly greater than the diameter of shaft 14. Slot 60 is generally aligned along the longitudinal axis of arresting arm 50 so as to be generally vertically oriented when beam 30 is in a horizontal position.

Figure 6:
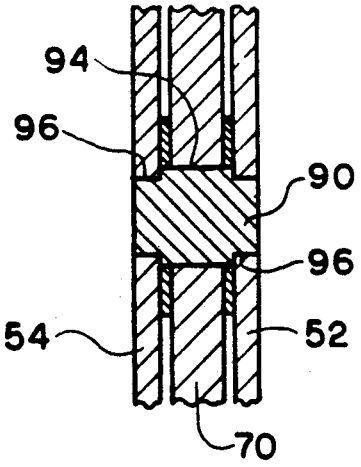
FIG. 6 is a sectional view taken along lines 6—6 of FIG. 2.

Referring now to FIG. 4, disposed between plates 52, 54 are a hook 70 and a latch 80. Hook 70 and latch 80 are mounted for free pivotal movement on mounting pins 90, 92, respectively. Pin 90, best seen in FIG. 6, includes a central portion 94 and reduced end portions 96. Central portion 94 is dimensioned to be positioned between plates 52, 54, wherein reduced end portions 96 extend into holes in plate 52, 54 such that pin 90 cannot be dislodged therefrom. In like respect, mounting pin 92 is similarly designed to prevent removal from between plates 52, 54.

Figure 7A:
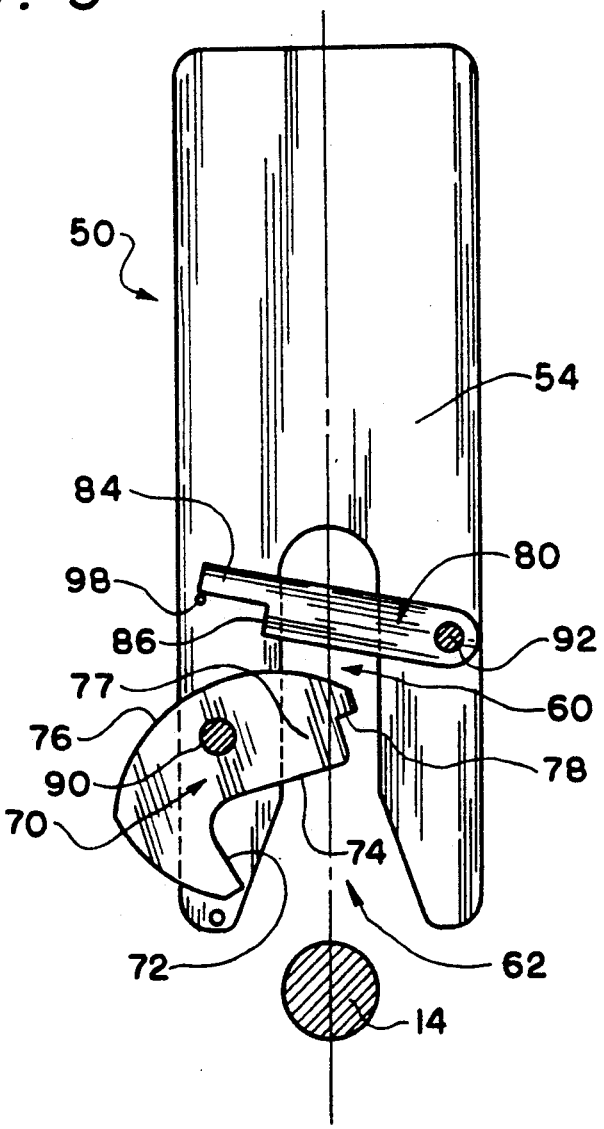
Figure 7F:
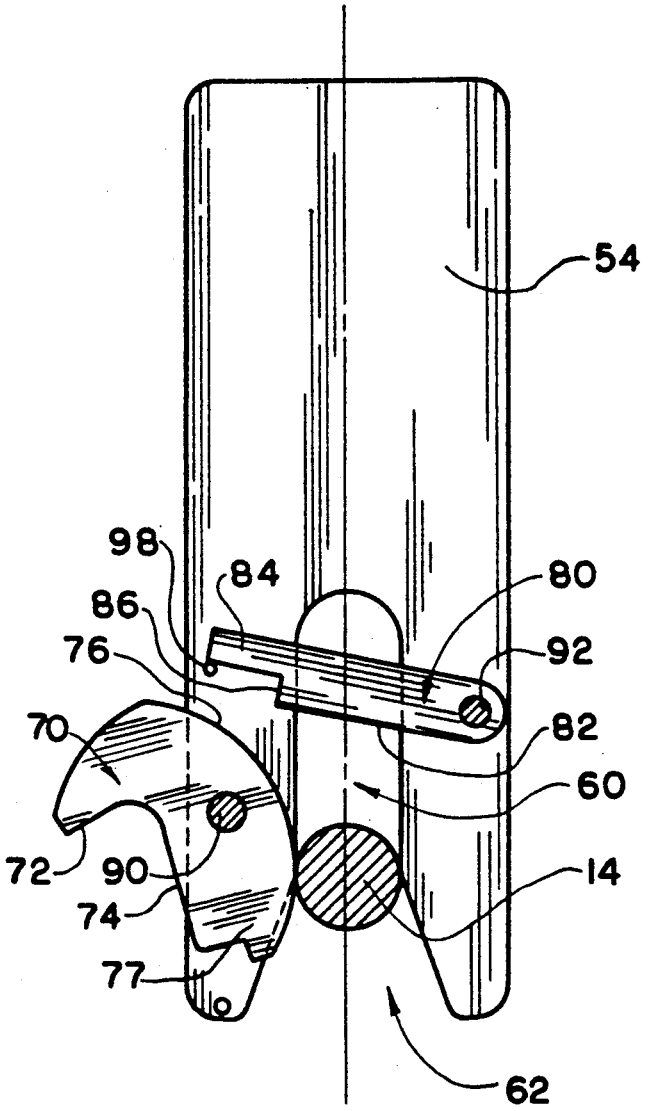

Hook 70 is generally L-shaped and has a predetermined outer profile. In this respect, hook 70 includes a support surface 72, forming an acute angle with a first cam surface 74, a second cam surface 76, and a notched end 77 having a latch abutting surface 78 thereon. As best seen in FIG. 4, hook 70 is mounted on pin 90 to one side of slot 60. According to the present invention, hook 70 is freely mounted on pin 90 and dimensioned such that hook 70 will normally assume a first, neutral position as shown in FIG. 7A, wherein hook 70 is generally balanced on pin 90. In this respect, hook 70 is specifically designed to freely rotate on pin 90 and to normally assume a position illustrated in FIG. 7A wherein notched end 77 is generally disposed within slot 60. A stop pin 98 is provided to limit rotation of hook 70 about pin 90 in both a clockwise or counterclockwise direction. Hook 70 is basically free to move approximately 180° about pin 90 which is positioned at about the vertical midpoint of the portion of hook 70 on which cam surface 74 is located, from a position shown in FIG. 7B wherein one end of surface 76 near notched end 77 engages stop pin 98 and a position wherein the other end of the surface 76 engages pin 98. Within this range of motion, hook 70 may assume the first, neutral position described above, and a second position, best seen in FIG. 4, wherein support surface 72 generally traverses slot 60.

Latch 80 is generally an elongated rectangular element having a cam surface 82 and a notched free end 84 defining a hook abutting surface 86 thereon. As shown in FIG. 4, latch 80 is pivotally mounted on a pin 92 at one end thereof so that notched end 84 is biased by gravity toward hook 70. In this respect, latch 80 is dimensioned to operatively engage hook 70 when hook 70 is in the second position, as best illustrated in FIG. 4. Latch 80 is dimensioned to engage stop pin 98, which limits the downward travel thereof.

Referring now to FIG. 2, a locking member 100 is shown. Locking member 100 is generally an elongated, rectangular plate positioned on the outer surface of plate 52. As best shown in FIGS. 2 and 3, locking member 100 is mounted for pivotal rotation on pipe 44. Locking member 100 includes a cylindrical boss 102 secured to one end thereof. Boss 102 is dimensioned to receive a conventional bearing 104. A hole extending through locking member 100 is formed to be in registry with the hole in bearing 104. Locking member 100 is dimensioned to overlay a predetermined portion of slot 60. An arcuate slot 108 dimensioned to receive a threaded rod therethrough is formed in locking member 100. Threaded rod 110 extends from the surface of plate 52 and is secured perpendicular therto. Threaded rod 110 is dimensioned to receive a threaded, winged nut 112, which is operable to be tightened and to secure locking member 100 against plate 52. Locking member 100 is movable between a first position (as seen in FIG. 2) wherein locking member 100 overlays a portion of slot 60, and a second position (shown in phantom in FIG. 2) wherein locking member 100 is disposed to one side of slot 60. In the embodiment shown, locking member 100 includes a notched portion 114 which is provided to ensure that slot 60 is completely uncovered when locking member 100 is in its second position, i.e. the furthest position in a counterclockwise direction.

Referring now to FIGS. 7A–7F, the operation of lifting device 10 will now be described. Lifting device 10 is operable to automatically grasp an elongated shaft on a workpiece or the like and to move the workpiece from a first location to a second location and automatically release the workload at the second location. To this end, in the embodiment shown, lifting device 10 is operable to grasp shaft 14 at the ends thereof when shaft 14 is disposed in a generally horizontal position. Important to the operation of the present invention, a predetermined spacing is required between shaft 14 and the nearest surface therebelow. Accordingly, shaft 14 is preferably elevated above the floor or a horizontal support surface as shown in FIG. 1. Lifting device 10 is dimensioned such that arrester arms 50 are generally perpendicular to shaft 14. In this respect, slot 60 and the respective arresting arms are operable to receive shaft 14 when shaft 14 is generally parallel to beam 30.

During the automatic operation of lifting device 10, locking member 100 is preferably moved to its second position, shown in phantom in FIG. 2, and locked thereat by means of wing nut 112.

FIG. 7A generally shows a sectional, elevational view of an arresting arm 50 positioned above a shaft 14 to be gripped, illustrating the respective position of hook 70 and latch 80. In this respect, hook 70 assumes its first, neutral position wherein first cam surface 74 is disposed within slot 60 generally facing shaft 14. Latch, 80, under the influence of gravity, assumes its first position resting on pin 98. As the arresting arm 50 is lowered by a conventional crane means (not shown), flared opening 62 of slot 60 guides shaft 14 into slot 60. As shaft 14 enters slot 60, it engages cam surface 74 and causes hook member 70 to rotate counterclockwise about pin 90. As shaft 14 proceeds through slot 60, hook 70 is forced by shaft 14 to pivot about pin 90 to the position shown in FIG. 7B wherein support surface 72 intersects slot 60 and is below shaft 14, and latch member 80 rests on shaft 14.

If lifting device 10 is moved upward, shaft 14 moves downward in slot 60 until support surface 72 engages the lower side of shaft 14. This movement of shaft 14 produces a slight shift in the counterclockwise direction by hook 70 which allows latch 80 to drop into mating engagement therewith, as illustrated in FIG. 7C. In this position, notched end 77 of hook 70 mates with notched end 84 of latch 80 to lock the respective components together; specifically, mating surface 78 on hook 70 abuts mating surface 86 on latch 80. In this position, further rotation of hook 70 (under the influence of the weight on shaft 14) is prevented by latch 80. Importantly, hook 70 and latch 80 are dimensioned such that the resultant force between the two components, resulting from the weight of shaft 14, acts in a direction between pins 90 and 92. In this respect, increasing the weight on support surface 72 of hook 70 tends to force hook 70 and latch 80 into tighter wedging engagement with each other. Thus, in the position shown in FIG. 7C, shaft 14 is supported by support surface 72 of hook 70 and may be transferred from its initial location to a second location.

According to the present invention, lift assembly 10 automatically releases shaft 14 when shaft 14 is resupported at the same or another location. In this respect, as shaft 14 is lowered by lifting device 10 onto a support, the weight of the load is removed from hook 70 which, in turn, loosens the wedging contact between hook 70 and latch 80. Further lowering of lifting device 10 causes shaft 14 (which is now supported) to move upward in slot 60 as illustrated in FIG. 7D. As shown in FIG. 7D, movement of shaft 14 toward closed end 64 of slot 60 forces latch 80 away from hook 70. As lifting device 10 is lowered further relative to the stationary shaft 14, shaft 14 moves past hook 70 as shown in FIG. 7E wherein hook 70 is free to assume its normal, balanced first position. At the same time, the end of slot 60 prevents further downward movement of lifting device 10, as it essentially rests on shaft 14. In this respect, the minimum distance between shaft 14 and the nearest floor of the support surface necessary for operation of the present invention is a distance wherein shaft 14 "bottoms out" in slot 60 before the lower-most ends of arresting arms 50 contact the floor surface.

From the position shown in FIG. 7E, upward movement of lifting device 10 causes stationary shaft 14 to operatively engage second cam surface 76 of hook 70 which causes hook 70 to pivot out of the way of shaft 14 as it moves out of slot 60. During such movement, latch 80, under the influence of gravity, drops onto pin 98 to assume its first, normal position resting thereon. In addition to supporting latch 80, pin 98 further prevents hook 70 from rotating too far wherein it may interfere with latch 80. As will be appreciated, once shaft 14 has cleared slot 60, hook 70 assumes its normal balanced, first position, wherein the entire assembly is once again in its normal position, as shown in FIG. 7A, and is thus ready to repeat the above-described cycle.

As indicated above, the operation of the invention as heretofore described occurs when locking member 100 is in its second position (shown in phantom in FIG. 2), i.e. when locking member 100 does not overlay slot 60. When locking member 100 is in the position shown in FIG. 2, i.e. where it overlays closed end 64 of slot 60, lifting device 10 is operable to grip shaft 14 and support same, but cannot automatically release shaft 14 when shaft 14 is resupported. In this respect, with the end of locking member 100 covering closed end 64 of slot 60, shaft 14 is prevented from contacting cam surface 82 on latch 80 and is prevented from moving past hook 70. Thus, hook 70 and latch 80 maintain their respective positions shown in FIG. 7C and shaft 14 will remain held by the lifting device.

The present invention thus provides a lifting device 10 which automatically grips and releases a workpiece having cylindrical portions without mechanical or electrical actuating devices and without the need for manual intervention. While the present invention has been described with respect to a preferred embodiment, modifications and alterations will occur to others upon the reading and understanding of the specification. It is intended that all such modifications and alterations be included insofar as they come within the scope of the invention as claimed or equivalents thereof.

Having described the invention, the following is claimed:

1. An arresting device for gripping a generally cylindrical shaft comprising:

plate means;

an elongated slot extending into said plate means, said slot being dimensioned to have a width slightly larger than the diameter of said shaft wherein said slot is operable to receive said shaft therein when said shaft is generally perpendicular to said plate means;

hook means having a hook inner cam surface, a support surface and a hook mating surface, said inner cam surface and said support surface forming an acute angle therebetween, and said hook means being pivotally mounted to said plate means at one side of said slot at about the vertical midpoint of the portion of said hook means on which said inner cam surface is located, said cam surface having a predetermined position relative to said support surface wherein said hook means has a first position wherein said first cam surface generally traverses said slot and a second position wherein said support surface generally traverses said slot;

latch means having a cam surface and a mating surface, said latch means being pivotally mounted to said plate means and disposed toward said hook means wherein said latch means cam surface intersects said slot and said latch means mating surface engages said hook mating surface to hold said hook means in said second position and to confine said shaft within said slot, and selectively securable locking means to prevent contact of said shaft with said latch means to prevent inadvertent release of said hook means.

2. A device as defined in claim 1 wherein said hook means has a center of gravity which causes gravity to bias said hook means to said first position.

3. A device for lifting an elongated object having generally cylindrical end portions comprising:

an elongated structural member; and, a pair of arresting arms mounted at the ends of said structural member, said arresting arms being generally parallel to each other, each of said arresting arms including:

plate means;

an elongated slot extending into said plate means, said slot being dimensioned to have a width slightly larger than the diameter of said cylindrical end portion wherein said slot is operable to receive said end portion, said slot having an open end and a closed end;

a generally L-shaped hook member pivotally mounted to said plate means for rotation about an axis disposed to one said of said slot, said hook member having a first end having a cam surface thereon and a second end having a support surface thereon, said cam surface being disposed at a predetermined acute angle relative to said support surface and said axis being disposed between said first and second ends at about the vertical midpoint of the portion of said hook member on which said cam surface is located, said hook member movable from a first position wherein said cam surface traverses said slot and faces said open end to a second position wherein said support surface traverses said slot and faces said closed end, said hook member operable to move from said first position to said second position when said cylindrical end portion is within said slot adjacent said cam surface;

latch means operable to engage said first end of said hook member to maintain said hook member in said second position when said cylindrical end portion is within said slot; and locking means being selectively securable to prevent contact of said cylindrical end portions with said latch means to prevent inadvertent release of said hook member.

4. A device as defined in claim 3 wherein said hook member has a center of gravity which causes gravity to bias said hook member to said first position.

5. A device for lifting an elongated object having generally cylindrical end portions comprising:

an elongated structural member; and a pair of arresting arms mounted at the ends of said structural member, each of said arresting arms being generally parallel to each other and including:

plate means;

an elongated slot extending into said plate means, said slot being dimensioned to have a width slightly larger than the diameter of said cylindrical end portion wherein said slot operable to receive said end portion, said slot having an open end and a closed end;

a generally L-shaped hook member pivotally mounted to said plate means for rotation about an axis disposed to one side of said slot, said hook member having a first end having a cam surface thereon and a second end having a support surface thereon, said cam surface disposed at an acute angle to said support surface and said axis being disposed between said first and second ends about the vertical midpoint of the portion of said hook member on which said cam surface is located, said hook member movable from a first position wherein said cam surface traverses said slot and faces said open end to a second position wherein said support surface traverses said slot and faces said closed end, said hook member operable to move from said first position to said second position when said cylindrical end portion is within said slot adjacent said cam surface;

latch means operable to engage said first end of said hook member to maintain said hook member in said second position when said cylindrical end portion is within said slot; and locking means being selectively securable to prevent contact of said cylindrical end portions with said latch means to prevent inadvertent release of said hook member, wherein:

said hook member includes a second cam surface;

said hook member is normally disposed in said first position;

said hook member is movable to a third position wherein said hook member first end cam surface and said support surface do not intersect said slot; and said slot is dimensioned to permit said end portion to move beyond said hook member, movement of said end portion beyond said hook member causing said end portion to engage said latch means and move said latch means away from said hook member, further movement of said end portion beyond said hook member enabling said hook member to move to said first position wherein said end portion is position in said slot between said closed end thereof and said second cam surface, subsequent movement of said end portion toward said open end of said slot causing said end portion to engage said second cam surface.

* * * * *